US005927356A

United States Patent [19]

Henderson

[11] Patent Number: 5,927,356

[45] Date of Patent: Jul. 27, 1999

[54] PORTABLE DEVICE FOR DISPENSING FLUENT MATERIALS INTO CONTAINERS

[76] Inventor: Raymond D. Henderson, RR#1 Corbyville, Ontario, Canada, K0K 1V0

[21] Appl. No.: 09/070,972

[22] Filed: May 1, 1998

[51] Int. Cl.[6] ..... B65B 1/04

[52] U.S. Cl. ..... 141/391; 141/314

[58] Field of Search ..... 141/10, 114, 313–317, 141/391

[56] References Cited

U.S. PATENT DOCUMENTS

| | | | |
|---|---|---|---|
| 121,529 | 12/1871 | Lum . | |
| 904,695 | 11/1908 | Herrick | 141/314 |
| 1,253,948 | 1/1918 | Dugas | 141/314 |
| 1,254,371 | 1/1918 | Smith | 141/314 |
| 1,575,233 | 3/1926 | Stillman | 141/314 |
| 3,552,346 | 1/1971 | Garden | 141/72 |
| 4,280,315 | 7/1981 | Von Hapsburg | 141/10 |
| 4,357,728 | 11/1982 | Pravettone | 141/314 |
| 4,819,701 | 4/1989 | Thornton | 141/231 |
| 4,892,224 | 1/1990 | Graham | 141/391 |
| 5,215,127 | 6/1993 | Bergeron | 141/10 |
| 5,397,085 | 3/1995 | Spagnolo | 248/97 |
| 5,417,261 | 5/1995 | Kanzler | 141/313 |
| 5,425,403 | 6/1995 | Herrmann | 141/314 |
| 5,575,315 | 11/1996 | Wengert | 141/109 |
| 5,597,145 | 1/1997 | Meyers | 248/97 |
| 5,673,734 | 10/1997 | Hawley | 141/108 |
| 5,687,781 | 11/1997 | Grizz | 141/316 |

*Primary Examiner*—Steven O. Douglas
*Attorney, Agent, or Firm*—Richard J. Hicks

[57] ABSTRACT

A portable device for receiving and dispensing , under gravity, particulate materials, preferrably sand, fed thereto into bags is described. A tapered hopper is supported on legs, which may be telescopically adjustable, has an open top, which is greater in width than the width of a shovel, and has an upstanding deflector around three sides to deflect material into the hopper. The lower end of the hopper is provided with a discharge chute having a diameter somewhat less than the diameter of a receiving bag. The outside of the chute is provided with a pair of upstanding tapered lugs or pins from which to suspend the receiving bag.

6 Claims, 2 Drawing Sheets

PORTABLE DEVICE FOR DISPENSING FLUENT MATERIALS INTO CONTAINERS

FIELD OF THE INVENTION

This invention relates to an apparatus for use in filling bags with sand or other fluent particulate materials such as earth, dirt, soil, clay, gravel, flour or sugar. More particularly, this invention relates to a portable, tapered hopper device to the lower end of which a cloth, fabric or plastic bag can be releasably secured to receive particulate material manually fed into the hopper.

BACKGROUND OF INVENTION

While this invention will be described with particular reference to filling sandbags, which are usually made of burlap or a woven plastic material, with sand, it will be appreciated that this invention may be used for many other applications in which it is desired to fill a fabric, plastic or paper bag with any number of different fluent materials such as, but not restricted to, dirt, soil, gravel, coal, cement, concrete mix, cereal grains such as wheat or corn, flour and sugar.

Sandbags are used in large quantities for a variety of applications, such as temporary flood dykes in flood control situations, in the construction of military fortifications for the protection of personnel and equipment, in the protection of pipes and pipelines in trenches, in the prevention of hillside erosion, and in the containment of environmentally damaging spills of oil and the like. Sandbags may also be used to remove contaminated soils and the like from a contaminated site for safe disposal. Sandbags are also frequently used as weights to hold down road signs and the like.

The conventional method of filling a sandbag with sand is manually employing three people, one to hold the mouth of the bag open at a convenient height to receive the sand, the second to lift shovelfuls of sand into the open mouth of the bag, and the third to remove the filled bag, tie the mouth of the bag and move it to the required site or to a pallet or the like for further transportation. The three workers rotate through all three jobs in order to reduce fatigue. This practice is time consuming, uses manpower inefficiently, results in considerable fatigue for all workers and presents considerable safety hazards related to back injuries and injuries to the hands of the person holding the bags during filling.

Numerous alternative methods for filling sandbags have been described in the art, Lum disclosed in U.S. Pat. No. 121529 of 1871 a funnel system and a stand to support a bag during the filling process, for use primarily in filling grain bags. Lum's did not, however, address issues such as portability, use on uneven terrain, or effective use of manpower. U.S. Pat. No. 5,397,085 issued Mar. 14, 1995 to Spagnalo describes a portable sandbag filling device comprising a hoop member, supported by a frame, into which a bag to be filled can be inserted and the top thereof turned over. The turned over top is secured by a second, concentric, hoop having an arcuate fill-chute member extending upwardly therefrom. This arrangement effectively holds the bag open for filling but removal of the filled bag is slow and cumbersome because the second concentric hoop must be removed first, and insertion of an empty bag is time consuming. A somewhat similar portable arrangement is shown in U.S. Pat. No. 5,597,145 issued Jan. 28, 1997 to Meyers et al. in which a sandbag support section is supported on a plurality of legs. The top of the bag is turned over the top of the support and held in place with a plurality of clips. No fill chute is provided. Removal of the filled bag is cumbersome and time consuming. Static hopper arrangements for use in filling sandbags are described in numerous patents of which U.S. Pat. No. 5,417,261 issued May. 23, 1995 to Kanzler et al. and 5,215,127 issued Jan. 1, 1993 to Bergeron may be considered illustrative. In both of these patents particulate materials, such as sand, are fed to one or more hoppers and thence to a discharge chute beneath which a bag may be held for filling. Neither of these devices, however, is light enough to be carried by a single person and hence cannot easily be used in the field and away from a road.

Usually large quantities of sandbags are required for applications such as flooding, military fortifications and pipeline support. They are invariably required quickly, and in emergency situations which often occur in the field, they are often needed at remote sites and on variable terrain. In such situations, however, there is usually an abundance of manual labour readily available.

OBJECT OF INVENTION

It will be appreciated, therefore, that there is a need for an improved portable sandbag filling device that minimizes labour and which can be easily carried by a single person to a remote site in the field, and it is an object of the present invention to provide such a sandbag filling device.

BRIEF STATEMENT OF INVENTION

By one aspect of this invention there is provided a portable device for receiving and dispensing particulate fluent materials manually fed thereto, comprising:

(a) a tapered hopper means for receiving said fluent material, having, when in operative position, an open top having a width greater than that of a shovel used to manually feed said fluent material thereto; side walls tapering downwardly and inwardly towards a lower discharge means having a diameter less than that of a bag means adapted to receive said fluent material;

(b) a plurality of ground engaging leg members, operatively connected to said hopper means;

(c) deflector means mounted on said open top of said hopper means so as to deflect fluent materials directed thereagainst into said hopper means; and (d) hook means mounted externally on said discharge means and arranged to receive and releasably retain said bag means.

DETAILED DESCRIPTION OF A PREFERRED EMBODIMENT

Figure 1:
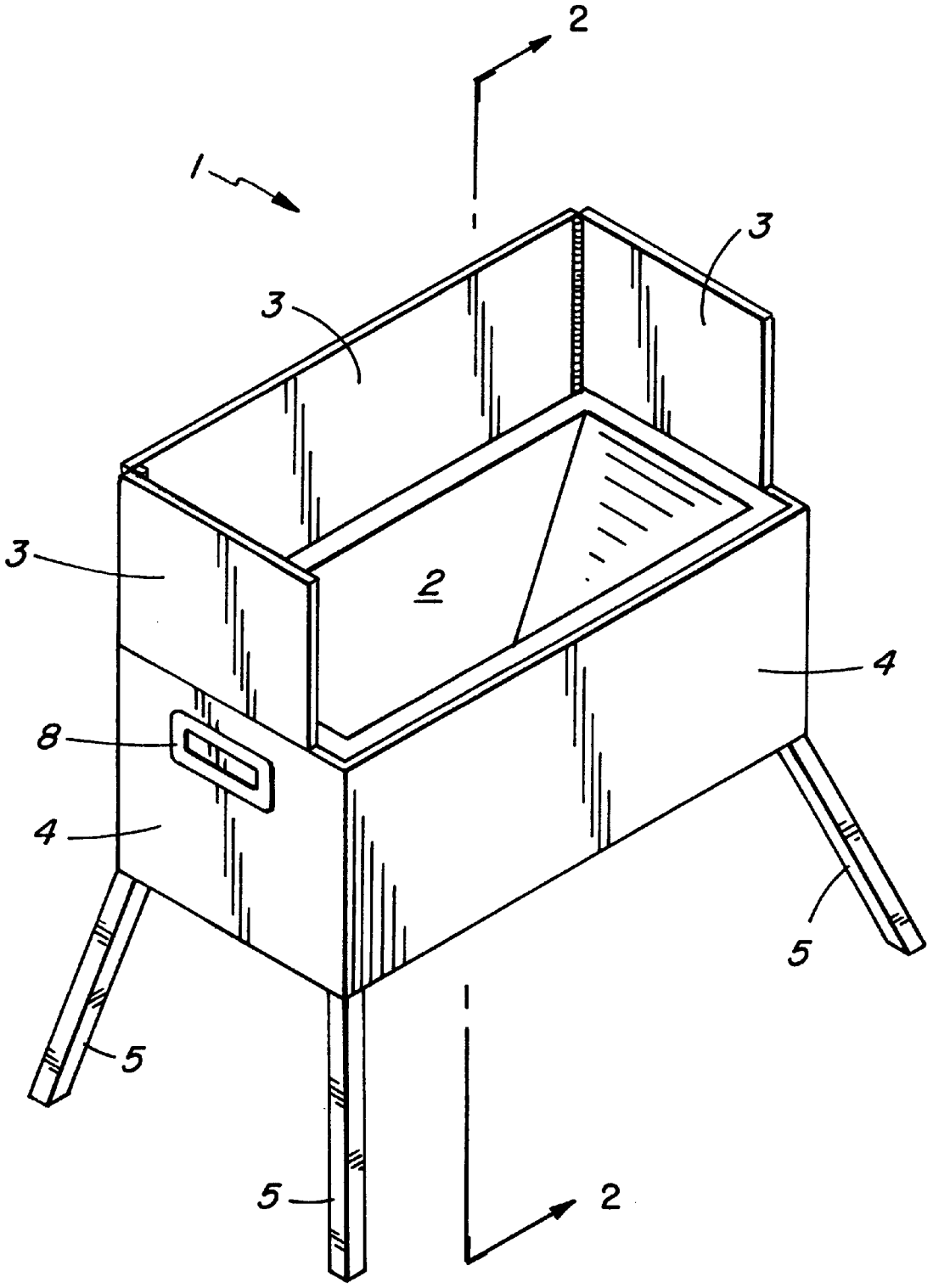
FIG. 1 is an isometric view of one embodiment of the present invention.

In FIG. 1 a portable device 1 for use in the manual filling of sandbags is shown. The device 1 includes a tapered hopper 2, a material deflector 3, a frame assembly 4, legs 5, and lifting handles 8. The hopper 2 may be constructed from any number of materials provided that the material is lightweight, smooth and durable, such as a thermoplastic such as nylon, polyethylene or polypropylene, a metal such as steel or aluminum, or a fibre reinforced thermosetting resin material. As seen more clearly in FIGS. 2 and 3, the hopper 2 has an open top and inwardly and downwardly sloping sides towards the discharge chute 6 to receive sand at the top and discharge it, under gravity, through chute 6 into a sandbag supported therebelow. Above hopper 2 there is mounted one or more material deflector plates 3, the purpose of which is to provide an enlarged target or backstop for shovelfuls of sand directed thereagainst and direct the sand into the hopper 2. The deflector plates 3 are open at the front and somewhat wider than the width of a spade or shovel so as to permit sand to be directed easily into the hopper 2, while at the same time stopping and deflecting sand into the hopper 2 which would otherwise have missed the target and spilled over onto the ground. Preferrably, but not essentially, deflector plates 3 are connected to the top edge of the hopper 2 by hinges or the like so that they can be raised and locked in place as material deflectors or lowered and locked down as a cover or top to enclose the frame assembly 4 for compactness in storage and for portability. The deflector also acts as a safety shield against thrown sand and protects the operator removing the filled bags from the opposite side of the device from the shoveller.

The legs 5 support the entire frame assembly 4 and extend downwardly and slightly outwardly so as to provide stability when shovelfuls of sand are thrown into hopper 2 and/or against deflector plates 3. In a preferred embodiment they may be swivel mounted, and individually telescopically or otherwise adjustable in length so as to permit the hopper 2 to be leveled horizontally on uneven terrain and at a comfortable height to receive sand from any selected shoveller. Preferrably the legs 5 may be stowed inside the frame 4 when the device 1 is not in use thereby enhancing compactness and portability. The legs 5 may be detachable from the frame or they may be foldable.

Figure 2:
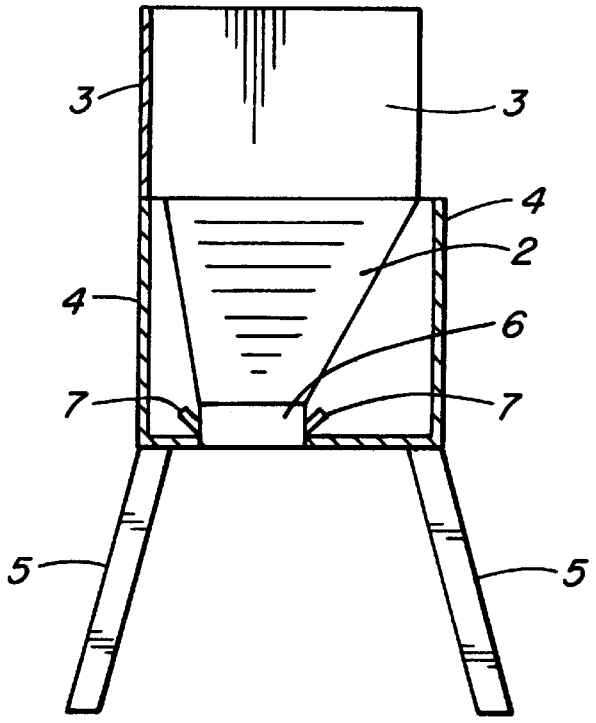
FIG. 2 is a left side elevational view of the device of FIG. 1, taken along section line 2—2 of FIG. 1, showing the deflector in its extended position.
Figure 3:
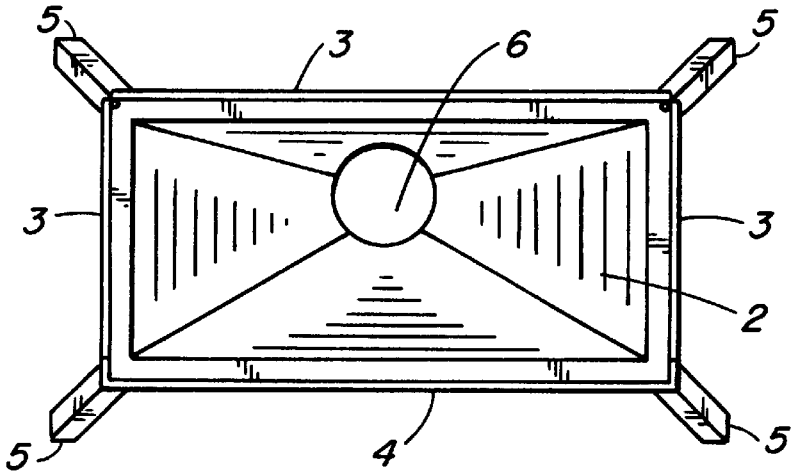
FIG. 3 is a top plan view of the device of FIG. 1.

In FIGS. 2 and 3, the discharge chute 6 is shown as a circular chute but it will be appreciated that this is not essential and that any convenient shape will be equally operative. Preferrably the diameter of chute 6 is slightly smaller than the diameter of the mouth of a standard sandbag, which is about 9 inches, in order to facilitate attachment of the empty bag and removal of the filled bag. In a preferred embodiment, as shown in FIG. 3 the chute 6 is offset towards the rear of the device 1, again in order to facilitate the attachment and removal of bags from the chute 6. In order to attach the bag to chute 6, a pair of pins or lugs 7 are provided on opposite sides of the chute 6, as seen in FIG. 2. The pins 7 extend upwardly and outwardly and are generally tapered to facilitate impaling a bag thereon. Other attachment devices, such as clips, clamps or pressure devices may also be employed. In a preferred embodiment, the rear of the frame assembly 4 (i.e. the side away from the shoveller) may be cut away (not shown in the drawings) to improve access to the discharge chute and facilitate attaching and removing sandbags by the operator responsible for the filled bags. Note also that it is preferrable to keep the discharge chute within the confines of the frame assembly so as to facilitate stacking devices one on the other for storage purposes.

It will be appreciated that the device of the present invention is configured to be compact and manually portable so that it can not only be delivered to a remote site with ease but it may also be readily moved from local site to local site as necessary, thus, rather than having to fill sandbags at a central location and then move them to the required site by manual labour, the sandbags can be filled at the required site and thus require minimum movement. While a crew of three persons is recommended to make the most efficient use of the device of the present invention, it will be appreciated that the device of the present invention can be used by one person alone to fill sandbags with increased productivity and minimal fatigue as compared to a single person filling sandbags by the conventional method of holding a sandbag open with one hand while shovelling with the other hand.

I claim:

1. A portable device for receiving and dispensing particulate fluent materials manually fed thereto, comprising:

(a) a tapered hopper means for receiving said fluent material, having, when in operative position, an open top having a width greater than that of a shovel used to manually feed said fluent material thereto; side walls tapering downwardly and inwardly towards a lower discharge means having a diameter less than that of a bag means adapted to receive said fluent material;

(b) a plurality of ground engaging leg members, operatively connected to said hopper means;

(c) deflector means mounted, when in said operative position, in fixed, locked, relationship on said open top of said hopper means and extending upwardly therefrom so as to deflect fluent materials directed thereagainst into said hopper means; and (d) lug means fixedly mounted externally on said discharge means and arranged to receive and releasably retain said bag means.

2. A portable device as claimed in claim 1, wherein said hopper means is contained within a frame means and said leg members are mounted on said frame means.

3. A portable device as claimed in claim 2, wherein said leg members are adjustable to any selected length.

4. A portable device as claimed in claim 2, wherein said deflector means is hingedly connected to said hopper means.

5. A portable device as claimed in claim 2, wherein said discharge means comprises chute means contained within said frame means.

6. A portable device as claimed in claim 2, wherein said discharge means is offset towards a longitudinal side of said frame means adjacent said deflector means.

* * * * *